US009523375B2

(12) United States Patent
Wu et al.

(10) Patent No.: US 9,523,375 B2
(45) Date of Patent: Dec. 20, 2016

(54) FAN BLADE STRUCTURE AND CENTRIFUGAL FAN USING THE SAME

(71) Applicant: ASUSTek COMPUTER INC., Taipei (TW)

(72) Inventors: Ming-Hsiu Wu, Taipei (TW); Sung-Chuan Huang, Taipei (TW); Yi-Chi Lai, Taipei (TW); Ta-Ching Kuan, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 476 days.

(21) Appl. No.: 14/096,706

(22) Filed: Dec. 4, 2013

(65) Prior Publication Data

US 2015/0030441 A1 Jan. 29, 2015

(30) Foreign Application Priority Data

Jul. 25, 2013 (TW) ..... 102126681 A

(51) Int. Cl.
*F04D 29/66* (2006.01)
*F04D 29/28* (2006.01)
*F04D 29/30* (2006.01)

(52) U.S. Cl.
CPC ..... *F04D 29/666* (2013.01); *F04D 29/281* (2013.01); *F04D 29/30* (2013.01)

(58) Field of Classification Search
CPC ..... F04D 29/242; F04D 29/243; F04D 29/30; F04D 29/18; F04D 29/2216; F04D 29/2233; F04D 29/2255; F04D 29/26; F04D 29/28; F04D 29/281; F04D 29/66; F04D 29/661; F04D 29/663; F04D 29/666
USPC ..... 416/223 B, 228, 235, 236 R, 23, 242, 7,416/179, 180, 182, 183, 185, 186 R; 415/203
See application file for complete search history.

(56) References Cited

U.S. PATENT DOCUMENTS 2,540,136 A * 2/1951 Oliphant ..... F04D 29/281 415/206
3,362,338 A * 1/1968 Stethem ..... F04D 29/2233 416/183
4,292,055 A * 9/1981 De Castella ..... F04D 29/701 261/89
4,484,860 A * 11/1984 Brenholt ..... F04D 29/281 416/179
7,136,285 B1 * 11/2006 Herbert ..... F04D 29/281 165/121
7,688,579 B2 3/2010 Hwang et al.

FOREIGN PATENT DOCUMENTS

CN 101073791 11/2007
CN 202447239 9/2012
JP S57-47187 A 3/1982

* cited by examiner

*Primary Examiner* — John K Fristoe, Jr.
*Assistant Examiner* — Brian O Peters
(74) *Attorney, Agent, or Firm* — Muncy, Geissler, Olds & Lowe, P.C.

(57) ABSTRACT

A fan blade structure applied to a centrifugal fan is provided. The fan blade structure includes a wheel hub and an annular vane. The wheel hub includes a plurality of connecting brackets, and the annular vane includes multiple crests and troughs which interlace to form a continuous curved surface. The continuous curved surface has an outer ring surface and an inner ring surface. The connecting brackets are connected to the inner ring surface and drive the annular vane to rotate.

6 Claims, 9 Drawing Sheets

FAN BLADE STRUCTURE AND CENTRIFUGAL FAN USING THE SAME

CROSS-REFERENCE TO RELATED APPLICATION

This application claims the priority benefit of Taiwan application serial No. 102126681, filed on Jul. 25, 2013. The entirety of the above-mentioned patent application is hereby incorporated by reference herein and made a part of specification.

BACKGROUND OF THE INVENTION

Field of the Invention

The invention relates to a fan blade structure and, more particularly, to a fan blade structure applied to a centrifugal fan.

Description of the Related Art

Most electronic devices, such as a notebook computer and a projecting device, generate much heat while operation. A heat dissipating device, such as a fan, is usually disposed inside the electronic device to remove heat from the electronic components to extend service life. Moreover, since the electronic devices become thinner, most electronic devices have less and less space for natural convection in casings. Thus, the thin electronic device usually uses a centrifugal fan to develop a forced convection inside the casting.

FIG. 1 is a schematic diagram showing a conventional centrifugal fan. The centrifugal fan 1 includes at least a casing 11 and a fan blade structure 12. The casing 11 forms an accommodating space and an air outlet 110. The fan blade structure 12 is disposed in the accommodating space. The fan blade structure 12 includes a plurality of blades 121 which draws air in and blows airflow out from the air outlet 110.

When the blades 121 rotate, the wake flow generated by the blades 121 hits the surface of a tongue structure 112 at the bottom of the casing 11. Each hitting point can be taken as a sound source of the narrow band noise. The wake flow would generate the blade passing tone noise which has large amplitude and a constant frequency according to a wave superposition principle. In other words, when a rotating speed of the conventional centrifugal fan increases, the level of the noise also increases.

BRIEF SUMMARY OF THE INVENTION

A fan blade structure which can reduce the blade passing tone noise is provided.

A fan blade structure applied to a centrifugal fan is provided. The fan blade structure includes a wheel hub and an annular vane. The wheel hub includes a plurality of connecting brackets. The annular vane includes multiple crests and troughs, and the crests and the troughs interlace to form a continuous curved surface. The continuous curved surface includes an outer ring surface and an inner ring surface, and the connecting brackets are connected to the inner ring surface and drive the annular vane to rotate.

A centrifugal fan is also provided. The centrifugal fan includes a fan blade structure, a motor and a casing. The fan blade structure includes a wheel hub and an annular vane. The wheel hub includes a plurality of connecting brackets. The annular vane includes multiple crests and troughs, and the crests and the troughs interlace to form a continuous curved surface. The continuous curved surface includes an outer ring surface and an inner ring surface, and the connecting brackets are connected to the inner ring surface and drive the annular vane to rotate. The motor is disposed in the wheel hub of the fan blade structure and drives the wheel hub of the fan blade structure to rotate. The casing encloses the fan blade structure and the motor, and an air outlet is formed at a side of the fan blade structure.

As stated above, the fan blade structure reduces the blade passing tone noise generated by the conventional centrifugal fan while operation.

These and other features, aspects and advantages of the present disclosure will become better understood with regard to the following description, appended claims, and accompanying drawings.

DETAILED DESCRIPTION OF THE EMBODIMENTS

A fan blade structure and a centrifugal fan using the same are illustrated with relating figures. The same symbols denote the same components, and most indirect relating components are omitted.

Figure 1:
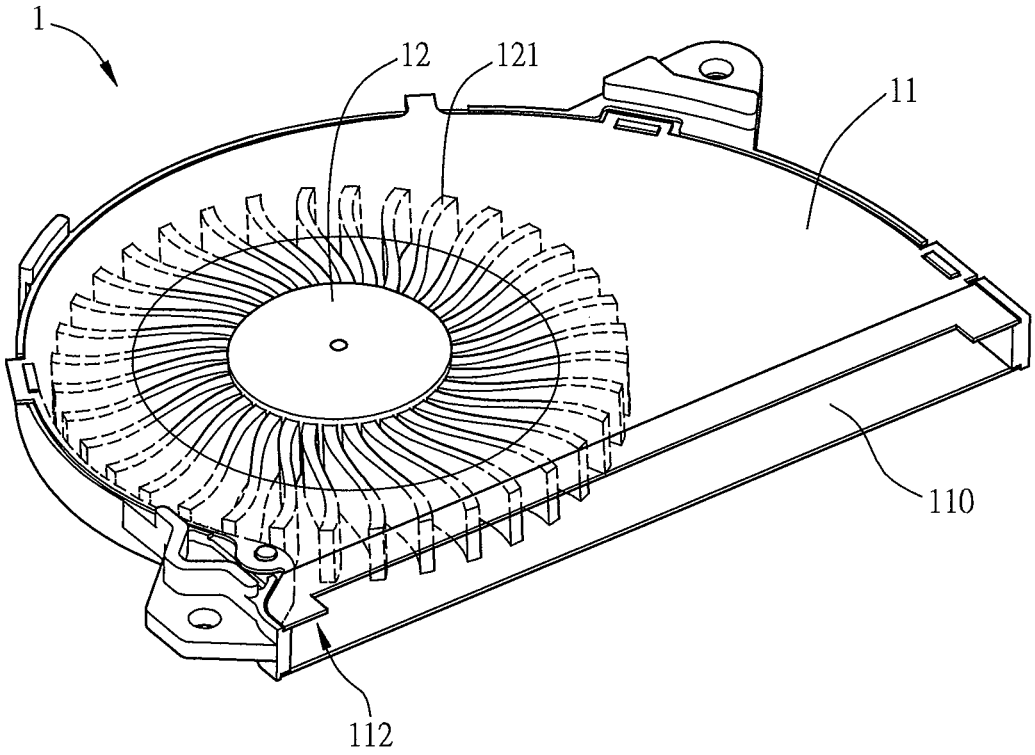
FIG. 1 (Prior Art)
FIG. 1 is a schematic diagram showing a conventional centrifugal fan.
Figure 2A:
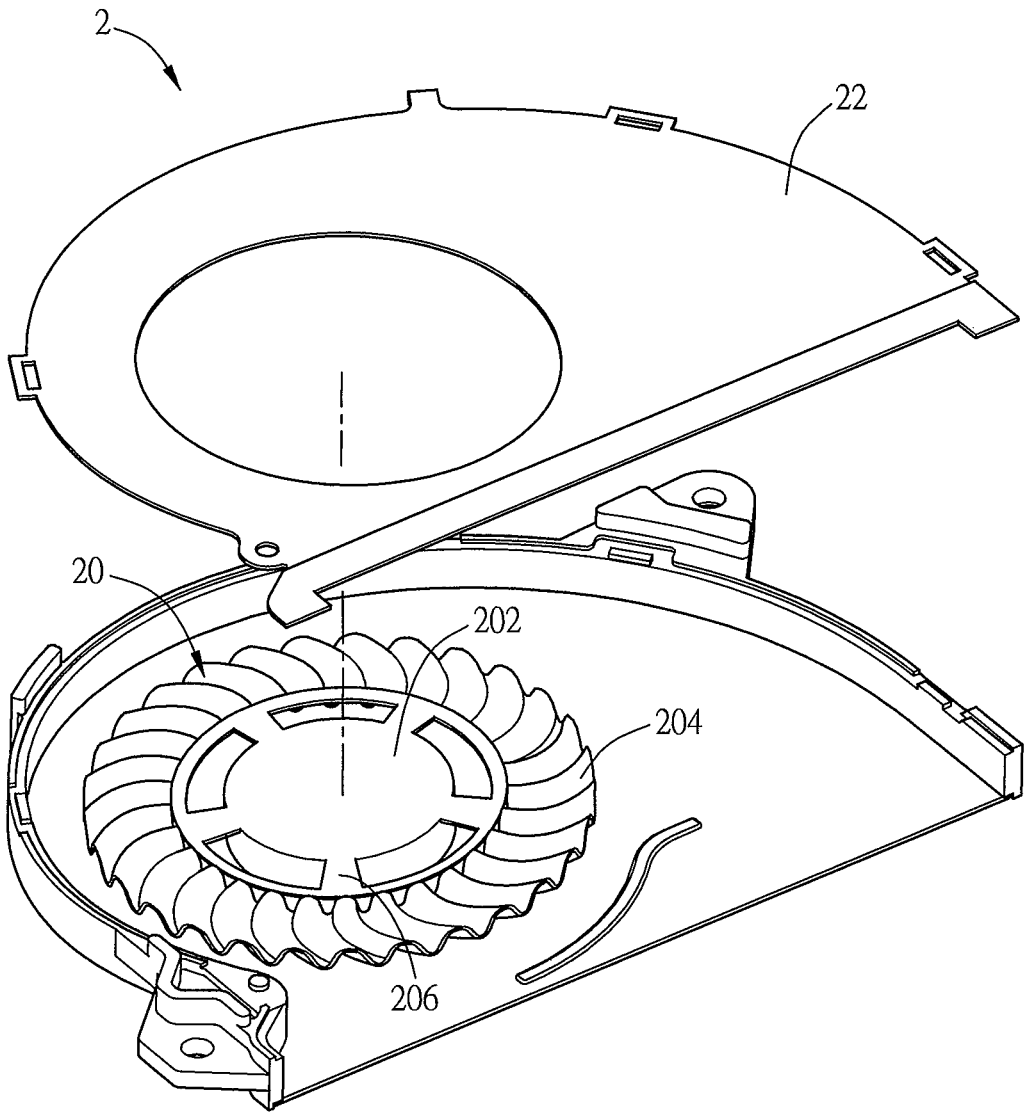
FIG. 2A is a partial exploded diagram showing a centrifugal fan in an embodiment.
Figure 2B:
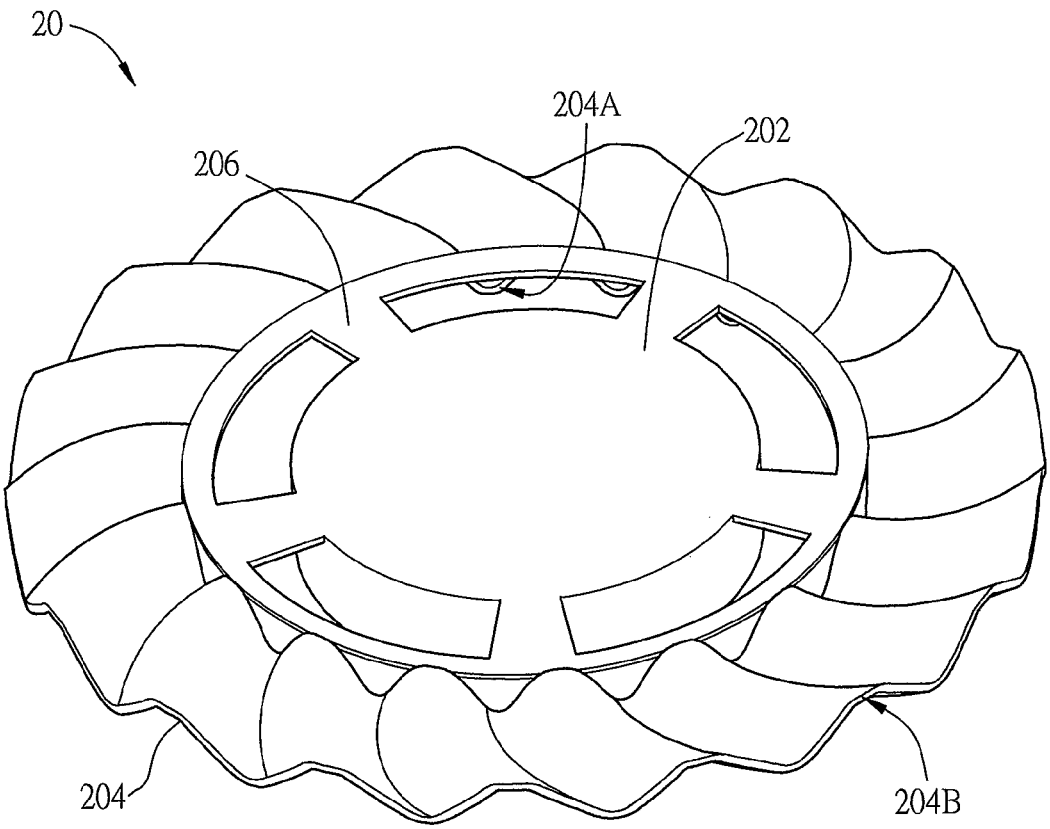
FIG. 2B is a schematic diagram showing a fan blade structure in a first embodiment.
Figure 2C:
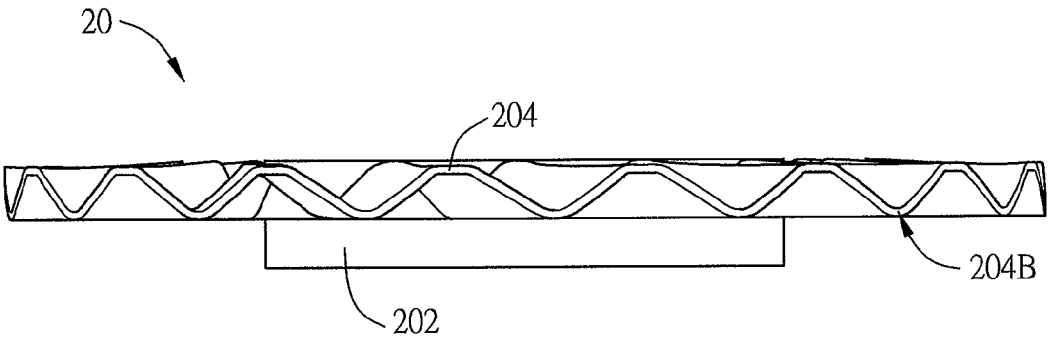
FIG. 2C is a side view showing the fan blade structure in FIG. 2B.

Please refer to FIG. 2A to FIG. 2C, FIG. 2A is a partial exploded diagram showing a centrifugal fan in an embodiment, FIG. 2B is a schematic diagram showing a fan blade structure in a first embodiment, and FIG. 2C is a side view showing the fan blade structure in FIG. 2B.

A centrifugal fan 2 includes a fan blade structure 20, a motor (not shown) and a casing 22.

The fan blade structure 20 includes a wheel hub 202 and an annular vane 204. The wheel hub 202 includes a plurality of connecting brackets 206, and the annular vane 204 includes multiple crests and troughs. The crests and the troughs interlace to form a continuous curved surface. The annular vane 204 has an outer ring surface 204B (one side of the continuous curved surface away from the wheel hub 202) and an inner ring surface 204A (one side of the continuous curved surface near the wheel hub 202). The connecting brackets 206 are connected to the inner ring surface 204A and drive the annular vane 204 to rotate.

The continuous curved surface of the annular vane 204 is a wave curved surface, and the crests and the troughs may change periodically. The number of the crests may be between 13 and 37 (the continuous curved surface has 18 crests in the embodiment), and the wave may be radial-blade, forward-blade type, backward-blade type or a combination in shape. The number and the shape of the crests and whether the crests change periodically can be adjusted according to outputted air volume and air pressure, which is not limited herein.

Moreover, the continuous curved surface of the annular vane 204 may have a streamlined appearance, and the streamlined appearance may be a smooth geometrical shape, which allows air passing through the surface of the annular vane 204 slowly and avoid generating vortex flow thus to reduce the noise.

The motor is disposed in the wheel hub 202 of the fan blade structure 20 and drives the wheel hub 202 of the fan blade structure 20 to rotate, so as to drive the annular vane 204 to rotate.

The casing 22 encloses the fan blade structure 20 and the motor, and an air outlet is formed at one side of the fan blade structure 20.

In operation, the motor drives the fan blade structure 20 to rotate, the annular vane 204 draws air in along a rotating axis (which is in parallel with a central vertical axis of the wheel hub 202). The air is blown out along a horizontal direction which is orthogonal to the rotating axis via the crests and the troughs of the annular vane 204, so as to force thermal convection and bring the heat away.

Since the annular vane 204 has a continuous curved surface and a changeable angle (which changes periodically or non-periodically) is formed between a normal direction of a crest of the annular vane 204 and the rotating axis, when the fan blade structure 20 draws air in, the air contacts with the annular vane 204 at different positions, and the wake flow generated by the fan blade structure 20 interacts with (or hits) the casing 22 at different positions. In other words, the air flow outputted by the fan blade structure 20 would not accumulate at the tongue structure of the bottom of the casing 22. Thus, the blade passing tone noise in a constant frequency of the conventional blade structure can be effectively reduced, and the centrifugal fan generates a lower blade passing tone noise at a rotating speed that is the same as a conventional centrifugal fan.

The blade structure can also be applied to a centrifugal fan which includes fins to reduce noise easily at the fins of a centrifugal fan.

The wheel hub 202, the annular vane 204 are independent components in the embodiment, but the wheel hub 202, the connecting brackets 206 and the annular vane 204 may be integrated to form a single component via synthetic resin injection molding, which is not limited herein.

Figure 2D:
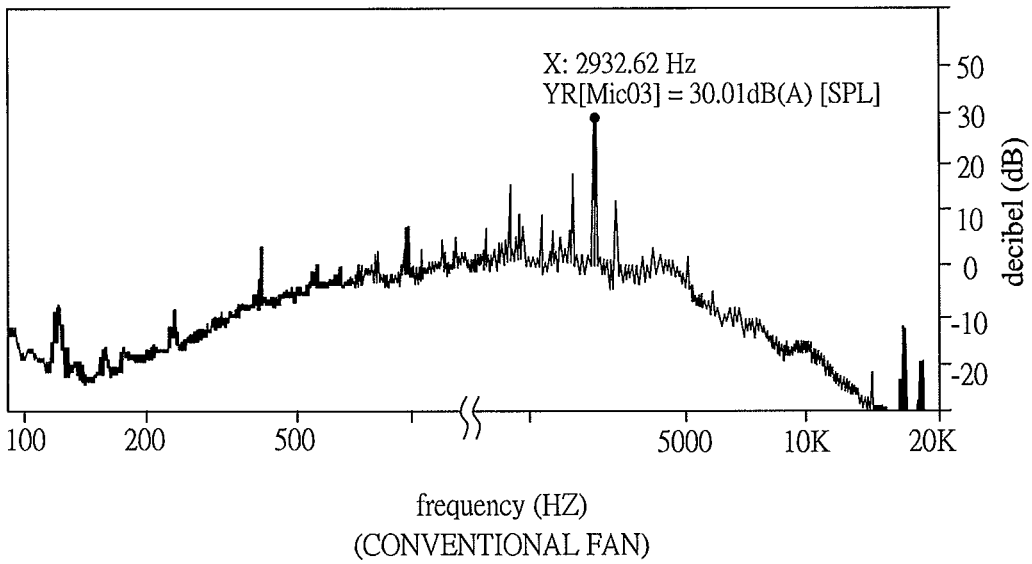
FIG. 2D (Prior Art)
FIG. 2D is a chart showing a frequency-decibel relation of a conventional centrifugal fan.
Figure 2E:
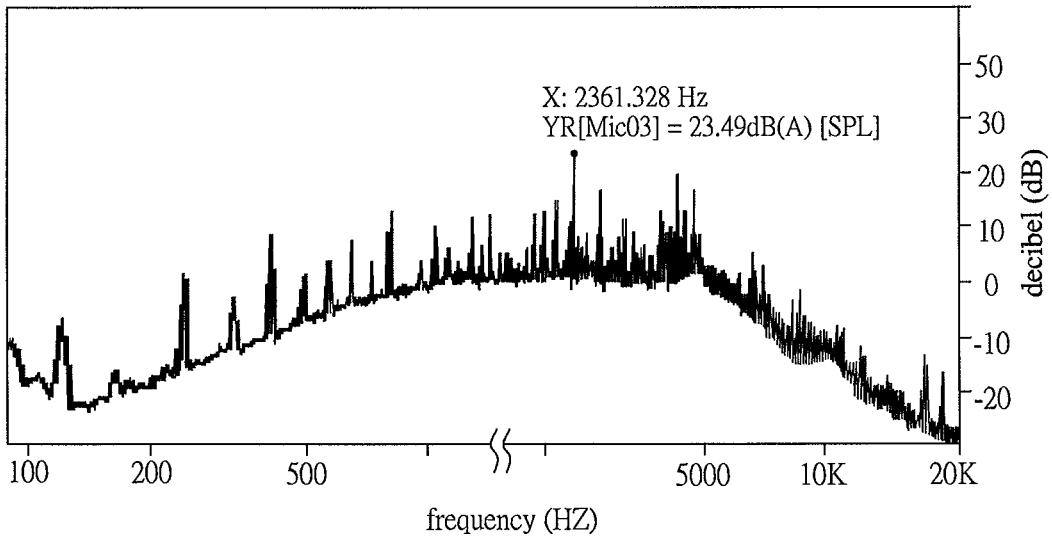
FIG. 2E is a chart showing a frequency-decibel relation of the centrifugal fan in FIG. 2B.
Figure 2F:
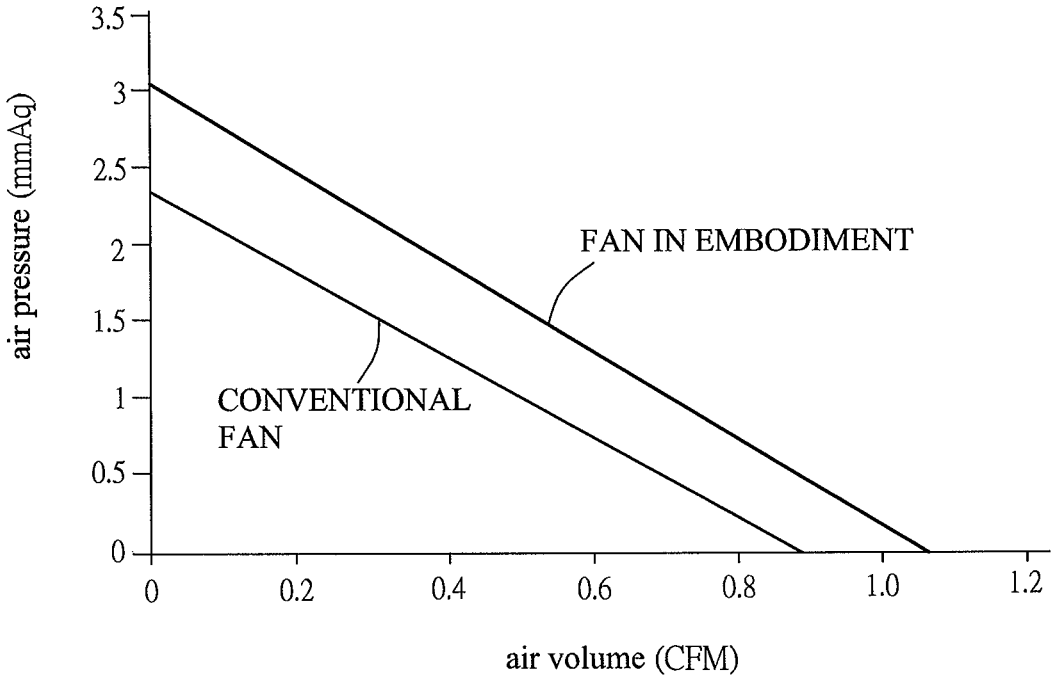
FIG. 2F are curves showing the relation between air pressure and air flow of the conventional centrifugal fan and the centrifugal fan in the embodiment.

Please refer to FIG. 2D to FIG. 2F, FIG. 2D is a chart showing a frequency-decibel relation of a conventional centrifugal fan, and FIG. 2E is a chart showing a frequency-decibel relation of the centrifugal fan in FIG. 2B.

As shown in FIG. 2D, the maximum amplitude of the blade passing tone noise generated by the centrifugal fan is 30 dB, and the difference between the maximum decibel amplitude and the minimum decibel amplitude in the chart is large. Thus, the noise generated by the conventional centrifugal fan is louder and makes the user feel noisy.

As shown in FIG. 2E, the maximum amplitude of the blade passing tone noise generated by the centrifugal fan is 23.5 dB, which is 6.5 dB smaller than that of the conventional centrifugal fan, and the difference between the maximum decibel amplitude and the minimum decibel amplitude in the chart is smaller, which results lower noise. As shown in FIG. 2D and FIG. 2E, the fan blade structure 20 can effectively reduce the blade passing tone noise.

FIG. 2F are curves showing the relation between air pressure and air flow of the conventional centrifugal fan and the centrifugal fan in the embodiment of the present disclosure. The Y axis represents air pressure (mmAq), and the X axis represents air volume (CFM). At the same rotating speed, the centrifugal fan 2 of the present disclosure effectively improves air pressure and air speed comparing with the conventional centrifugal fan, and the whole performance of the centrifugal fan 2 of the present disclosure is improved. As shown in FIG. 2F, the centrifugal fan 2 of the present disclosure can effectively improve the performance and reduce the blade passing tone noise.

Figure 3A:
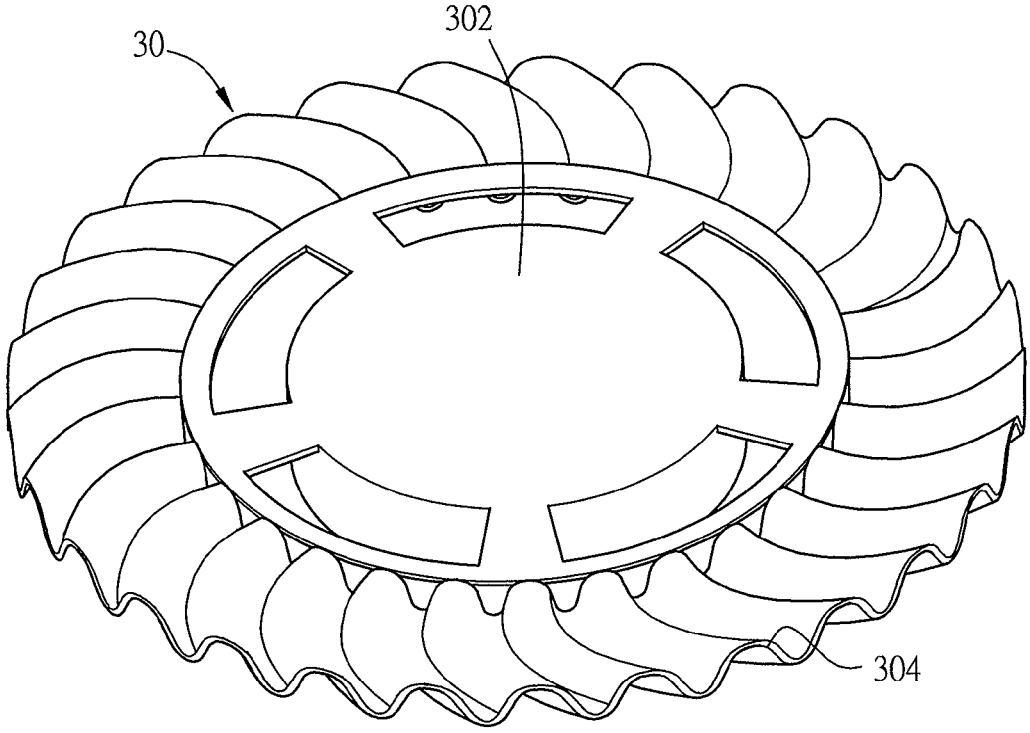
FIG. 3A and FIG. 3B are a schematic diagram and a side view showing a fan blade structure in a second embodiment, respectively.
Figure 3B:
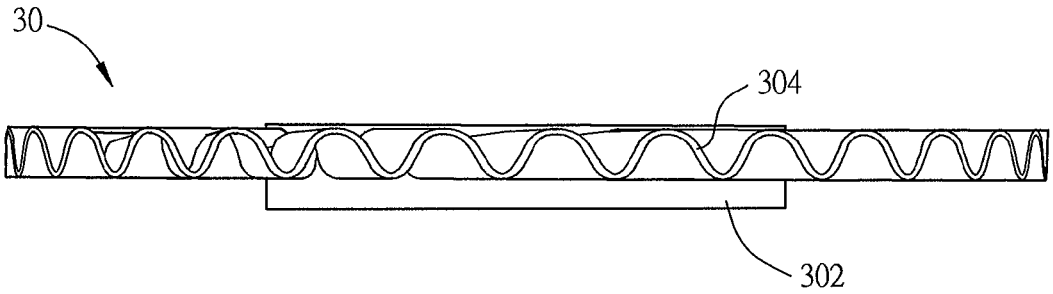

FIG. 3A to FIG. 6B are schematic diagrams and side views showing a fan blade structure in second to fifth embodiments, respectively. Similarly, the fan blade structure 30 in FIG. 3A and FIG. 3B includes a wheel hub 302 and an annular vane 304. The annular vane 304 includes multiple crests and troughs, and the crests and the troughs interlace to form a continuous curved surface which is a wave curved surface. The annular vane 304 includes more crests (29 crests), compared with that in the first embodiment, and the annular vane 304 in this embodiment can achieve better performance (which means larger air volume or higher air pressure). As shown in FIG. 3A, the fan blade structure 30 is the backward-blade type. Since blade angles may change at the same crest or trough, the fan blade structure 30 can generate a large airflow volume and does not affect the static pressure performance.

Figure 4A:
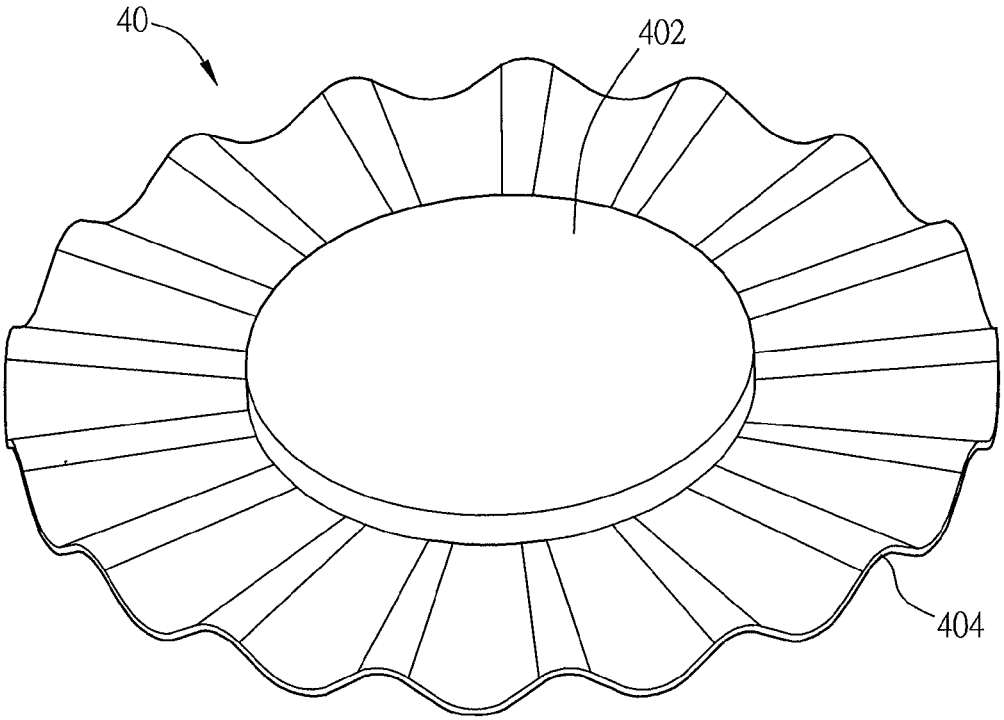
FIG. 4A and FIG. 4B are a schematic diagram and a side view showing a fan blade structure in a third embodiment, respectively.
Figure 4B:
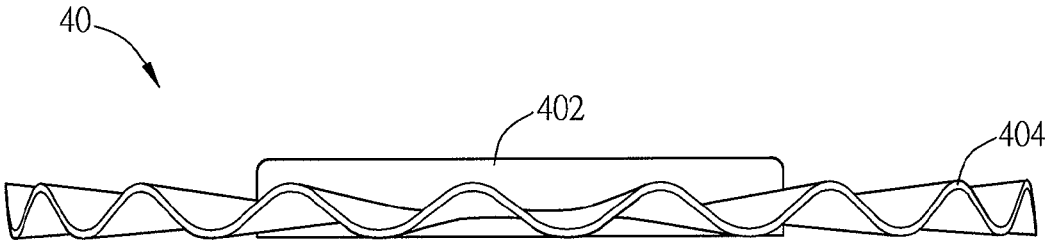

Please refer to FIG. 4 A and FIG. 4B, the fan blade structure 40 includes a wheel hub 402 and an annular vane 404. The difference between the embodiment and the above embodiments is that the annular vane 404 is directly coupled to the wheel hub 402, and the annular vane 404 is radial from the axis. The wheel hub 402, the annular vane 404 and the connecting brackets are integrated to form a single component. The fan blade structure 40 in the embodiment can increase air flowing space and reduce turbulent flow.

Figure 5A:
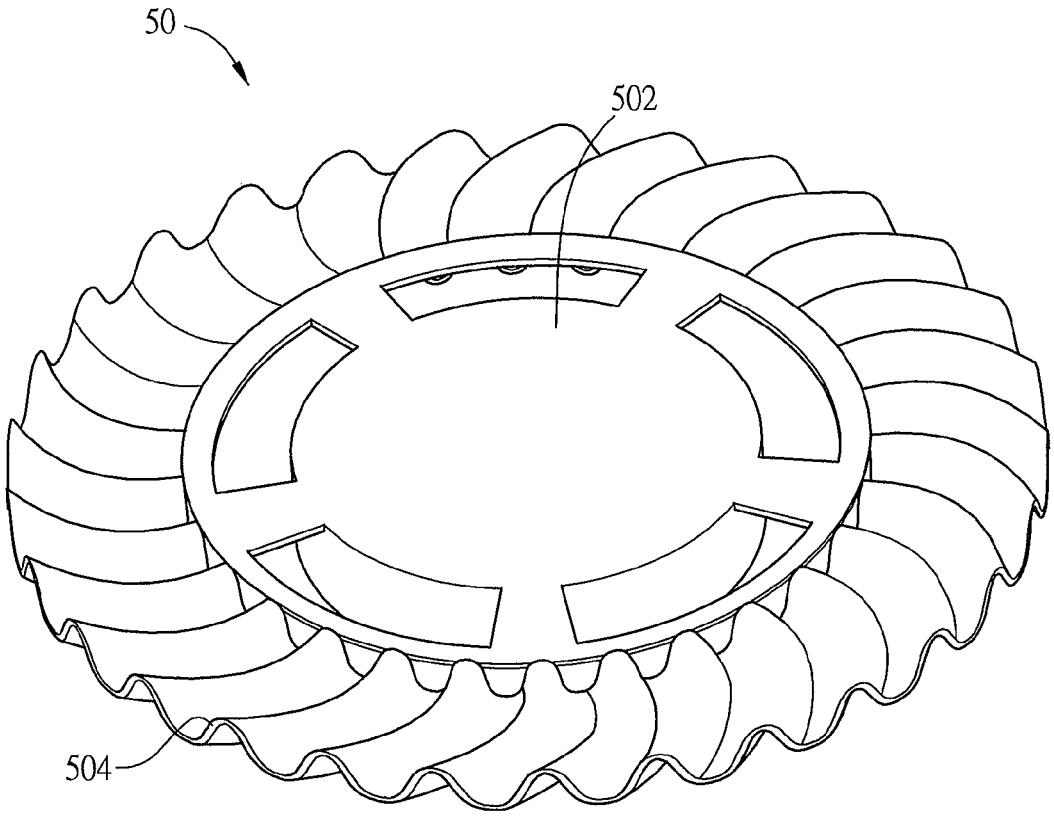
FIG. 5A and FIG. 5B are a schematic diagram and a side view showing a fan blade structure in a fourth embodiment, respectively.
Figure 5B:
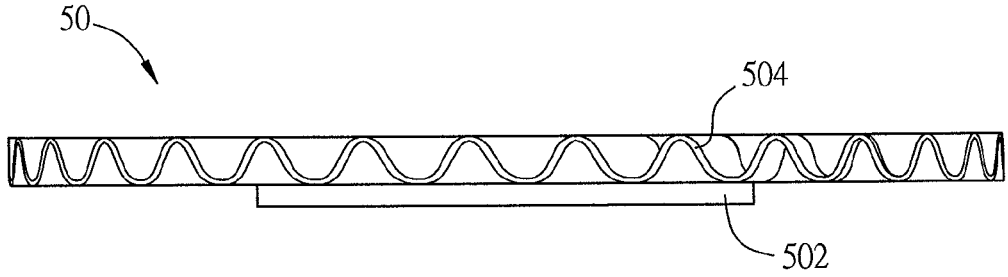

Please refer to FIG. 5A and FIG. 5B, the fan blade structure 50 includes a wheel hub 502 and an annular vane 504. The difference between the embodiment and the above embodiments is that the crests of the annular vane 504 are the forward-blade type. Thus, the fan blade structure 50 has the advantages of the forward-blade type blade and can reduce the blade passing tone noise.

Figure 6A:
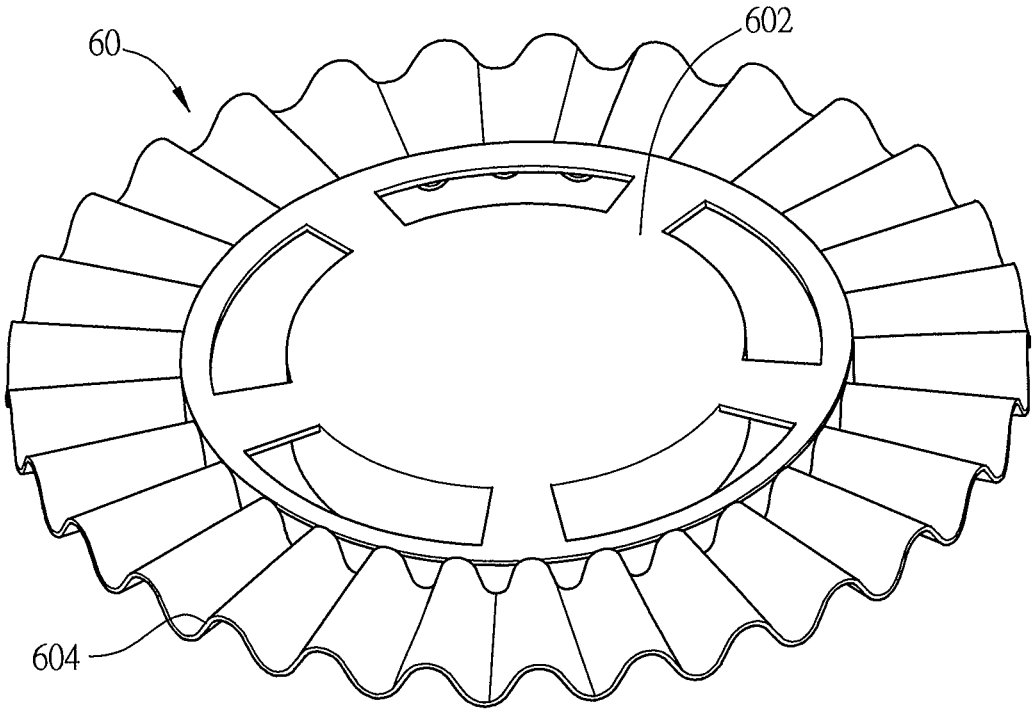
FIG. 6A and FIG. 6B are a schematic diagram and a side view showing a fan blade structure in a fifth embodiment, respectively.
Figure 6B:
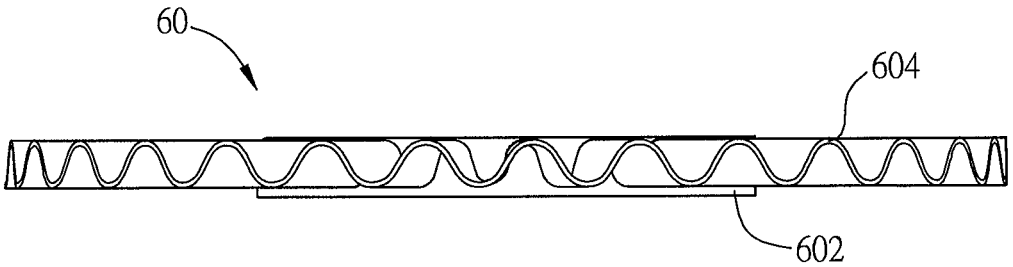

Please refer to FIG. 6A and FIG. 6B, the fan blade structure 60 also includes a wheel hub 602 and an annular vane 604. The annular vane 604 in the embodiment is a radial type blade, actually combination of forward and backward crests in shape, which has both advantages of the forward-blade type and the backward-blade type.

Moreover, the relation between the wheel hub and the annular vane of the fan blade structure, the cooperation of the fan blade structure, the casing, and the motor are similar with those in the first embodiment, which is omitted herein.

In sum, the annular vane which has a continuous curved surface draws air in at different time and different angles, so as to prevent the air outputted by the annular vane from hitting the same position at the casing and avoid noise superposition and the increase of the blade passing tone noise. Thus, the annular vane can effectively reduce the blade passing tone noise of the blade structure, and to compare with the conventional centrifugal fan, the centrifugal fan with the annular vane can generate lower blade passing tone noise at the same air speed.

Although the present disclosure has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A fan blade structure applied to a centrifugal fan, the fan blade structure comprising: a wheel hub including a plurality of connecting brackets; and an annular vane including multiple crests and troughs, wherein the crests and the troughs interlace to form a continuous curved surface, the continuous curved surface includes an outer ring surface and an inner ring surface, and the connecting brackets are connected to the inner ring surface and drive the annular vane to rotate about a rotating axis, wherein the continuous curved surface of the annular vane is a non-periodical change, and a changeable angle is formed between a normal direction of each crest of the annular vane.

2. The fan blade structure according to claim 1, wherein the continuous curved surface of the annular vane is a wave curved surface.

3. The fan blade structure according to claim 1, wherein the wheel hub, the annular vane and the connecting brackets are integrated to form a single component.

4. A centrifugal fan, comprising: a fan blade structure including a wheel hub and an annular vane, wherein the wheel hub includes a plurality of connecting brackets, the annular vane includes multiple crests and troughs, the crests and the troughs interlace to form a continuous curved surface, the continuous curved surface includes an outer ring surface and an inner ring surface, and the connecting brackets are connected to the inner ring surface, wherein the continuous curved surface of the annular vane is a non-periodical change, and a changeable angle is formed between a normal direction of each crest of the annular vane; a motor disposed in the wheel hub of the fan blade structure and driving the wheel hub of the fan blade structure to rotate about a rotating axis; and a casing wrapping the fan blade structure and the motor, wherein an air outlet is formed at a side of the fan blade structure.

5. The fan blade structure according to claim 4, wherein the continuous curved surface of the annular vane is a wave curved surface.

6. The fan blade structure according to claim 4, wherein the wheel hub, the annular vane and the connecting brackets are integrated to form a single component.

* * * * *